US006299281B1

(12) United States Patent
Shiida et al.

(10) Patent No.: US 6,299,281 B1
(45) Date of Patent: Oct. 9, 2001

(54) INK-JET PRINTER

(75) Inventors: Sakae Shiida, Numazu; Yoshihide Akuzawa, Shizuoka-ken; Hitoshi Ushiogi, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/434,739

(22) Filed: Nov. 5, 1999

(30) Foreign Application Priority Data

Nov. 11, 1998 (JP) ..... 10-320823

(51) Int. Cl.[7] ..... B41J 23/00
(52) U.S. Cl. ..... 347/37; 347/50
(58) Field of Search ..... 347/37, 39, 50

(56) References Cited

U.S. PATENT DOCUMENTS 6,149,262 * 11/2000 Shiida et al. ..... 347/37

FOREIGN PATENT DOCUMENTS 8-80611 3/1996 (JP) .
10-138520 A 5/1998 (JP) .

* cited by examiner

*Primary Examiner*—Huan Tran
(74) *Attorney, Agent, or Firm*—Frishauf, Holtz, Goodman, Langer & Chick, P.C.

(57) ABSTRACT

A nozzle unit is provided with nozzle heads of plural colors. Each nozzle head has a large number of ink-jet nozzles arranged side by side in the direction of main scanning. A head holder supports the nozzle unit in such a manner that the unit can move up and down between the printing position where printing is done on the printing sheet held on a rotating body and the non-printing position located above the printing position where the nozzle heads are maintained. The head holder is provided with a driving control circuit for driving the nozzle heads. The head holder, together with the nozzle unit, are movable vertically.

7 Claims, 4 Drawing Sheets

INK-JET PRINTER

BACKGROUND OF THE INVENTION

This invention relates to an ink-jet printer that prints by discharging ink at the printing surface from a nozzle head with a large number of ink-jet nozzles arranged in the printing direction.

One known serial ink-jet printer is such that each color nozzle head with an ink cassette is moved back and forth over the full length in the direction of main scanning, characters and graphics are printed line by line (or 1/N line at a time) on a printing medium, such as ordinary paper or OHP paper, during the back-and-forth movement of the nozzle head, the printing medium is fed one line in the direction of feed after one line has been printed, and those processes are repeated until a specific number of lines have been printed. Furthermore, for example, Jpn. Pat. Appln. KOKAI Publication No. 10-138520, filed by the applicant of the present invention, has disclosed an ink-jet printer which not only prints much faster than the above serial ink-jet printer but also enables the continues printing of a large number of sheets of paper and which can be made much smaller than a laser printer of the electrophotographic type.

With the above printer, the printing medium transferred from the paper feeder section is conveyed by the convey mechanism to a rotating body with a specific timing, which winds the medium around its outer surface (printing surface). The rotating body is rotated at, for example, 120 rpm on its central axis in the direction of feed.

The printer is provided with a nozzle unit. On the nozzle unit, there are provided nozzle heads of cyan C, yellow Y, magenta M, and black B which extend in the direction of axis of the rotating body and are arranged in the direction of feed, or the direction of rotation of the rotating body. Ink is supplied from an ink supply mechanism including an ink tank and a supply pump. The nozzle heads shoot ink of the respective colors at the printing medium.

While a reciprocating mechanism is moving the nozzle unit back and forth a specific distance (for example, a distance equivalent to the pitch between ink-jet nozzles) in the direction of main scanning, line printing is done on the rotating body in operation and at the same time, column printing is done in the direction of feed, making use of the rotation of the rotating body. Namely, row printing and column printing can be done simultaneously making use of the high-speed rotation of the rotating body, which makes the printing much faster (for example, at 20 ppm). After one page of print has been finished, the nozzle unit is returned to the original position. Thereafter, it moves back and forth to print the next page. The printing medium on which printing has been done is peeled from the rotating body and let out by an eject mechanism.

In the printer, since the nozzle heads of the individual colors are provided away from the ink tanks of the respective colors, the nozzle head of each color can be made lighter, which enables the reciprocating speed in the direction of row to be increased remarkably. This makes it possible to increase not only the printing speed more but also the capacity of the ink tank of each color remarkably. As a result, for example, more than 500 sheets of paper can be printed continuously.

To print characters and graphics continuously onto a larger number of sheet of the printing medium as described above, it is desirable that the nozzle head of each color should be maintained, for example, to prevent the head from clogging up, at regular intervals of, for example, three hours.

To make such maintenance possible, the nozzle unit is so provided that it can move in the horizontal direction between the printing position where the nozzle unit can print on the rotating body and the non-printing position where the nozzle unit is separated a specific distance away from the rotating body. After the nozzle heads have been moved to the non-printing position by the head moving mechanism including a motor and a rack, each nozzle head is maintained using a maintenance mechanism provided between the nozzle heads and the rotating body. After the maintenance, the head moving mechanism returns the nozzle unit to the printing position and the gap between the tip of each nozzle head and the printing surface is kept at, for example, about 1 mm.

It is difficult to produce the gap between the nozzle heads and the printing surface quickly and accurately at the printing position. Since the gap is directly related to the quality of print, the moving mechanism for the nozzle unit must be processed and assembled very accurately. As a result, the configuration of the printer as a whole is complex, which is liable to raise cost.

Even when the nozzle unit has been provided in the printing position very accurately, or the head moving mechanism has been locked after the positioning, if the head moving mechanism transmits the vibration of the motor to the nozzle unit side or if there is looseness in the component parts of the head moving mechanism including a motor, it is difficult to keep the gap accurately and stably without any fluctuation.

BRIEF SUMMARY OF THE INVENTION

It is, accordingly, an object of the present invention to provide an ink-jet printer which not only produces the gap between the nozzle heads and the printing surface rapidly and accurately but also is compact and easy to use.

The foregoing object is accomplished by providing an ink-jet printer comprising: a medium holding member for holding a printing medium; a head holder which supports nozzle heads and is provided in such a manner that the head holder can move up and down freely between a printing position where the nozzle heads print on the printing surface of the printing medium and a non-printing position located above the printing position where the nozzle heads are maintained, the nozzle heads facing the printing surface of the printing medium held by the medium holding member, with a specific gap between the nozzle heads and the printing surface; a elevating mechanism for moving the head holder up and down; and a driving control circuit which is so provided on the head holder that it, together with the head holder, can move up and down freely and drives the nozzle heads.

With the ink-jet printer, after the maintenance of the nozzle heads held in the non-printing position has been completed, the head holder lowers the nozzle heads from the non-printing position to the printing position and printing is done, with the gap between the heads and the printing surface being kept at a specific value. In the printing position, the relative position between the nozzle heads and the printing surface is kept by using, for example, gravitation. This enables the gap to be produced quickly and accurately.

Since the driving control circuit for the nozzle heads of the individual colors is provided on the head holder in such a manner that the circuit, together with the nozzle head, can move up and down, the harnesses connecting the driving control circuit to the corresponding nozzle heads can be minimized, which eliminates use of a long harness with a wide curve. This helps reduce production cost, facilitate the layout of the inside of the printer, and make the printer smaller. Furthermore, the harnesses themselves do not prevent the driving control circuit from dissipating heat. In addition to this, the area of the driving control circuit can be increased with relative ease by provided the driving control circuit on the head holder. Consequently, the heat dissipating capability is improved. Since the driving control circuit is close to the nozzle heads, adjustment and handling are easy. Up-and-down movement of the head holder enhances the heat dissipation of the driving control circuit, which facilitates positive heat dissipation and cooling measures.

Therefore, it is possible to provide an ink-jet printer which enables the gap between the nozzle heads and the printing surface to be produced quickly and accurately and the driving control circuit to dissipate heat easily and which can be made smaller on the whole.

In the ink-jet printer of the invention, the driving control circuit is located on the opposite side of the printing surface via the nozzle heads in the direction in which the head holder moves up and down and is provided on the head holder. This facilitates the wiring of the harnesses connecting the driving control circuit to the nozzle heads and therefore the adjustment of the nozzle heads.

In the ink-jet printer of the invention, the medium holding member includes a rotating body with an outer surface around which the printing medium is wound; the head holder includes a nozzle unit holding the nozzle heads, an almost frame-shaped cover which has a lower opening facing the rotating body and an upper opening facing the lower opening and is provided so as to surround the nozzle unit, and a printed-circuit board which closes the upper opening made in the cover and on which the driving control circuit is mounted; and the cover and printed-circuit board define a space for generating a wind to cool the nozzle unit and driving control circuit.

With the above configuration, use of a wind produced by the rotation of the rotating body improves the heat dissipation more. In addition, the rotating body is prevented from coming into contact with the harnesses connecting the driving control circuit to the nozzle heads and with the cable connecting the driving control circuit to an external circuit.

Furthermore, in the ink-jet printer of the invention, the cover has a pair of side plates each located on the upstream side and downstream side in the direction of rotation of the rotating body and ventholes each made in the side plates. Fresh air intake means, such as an air intake fan, is provided so as to face one of the ventholes.

With the above configuration, fresh air is let into the inside of the cover by making use of the rotation of the rotating body in one direction, thereby improving the cooling efficiency of the nozzle heads and the driving control circuit. Additionally, fresh air is forced to flow into the inside of the cover by using a fan or the like, thereby improving the cooling effect more.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
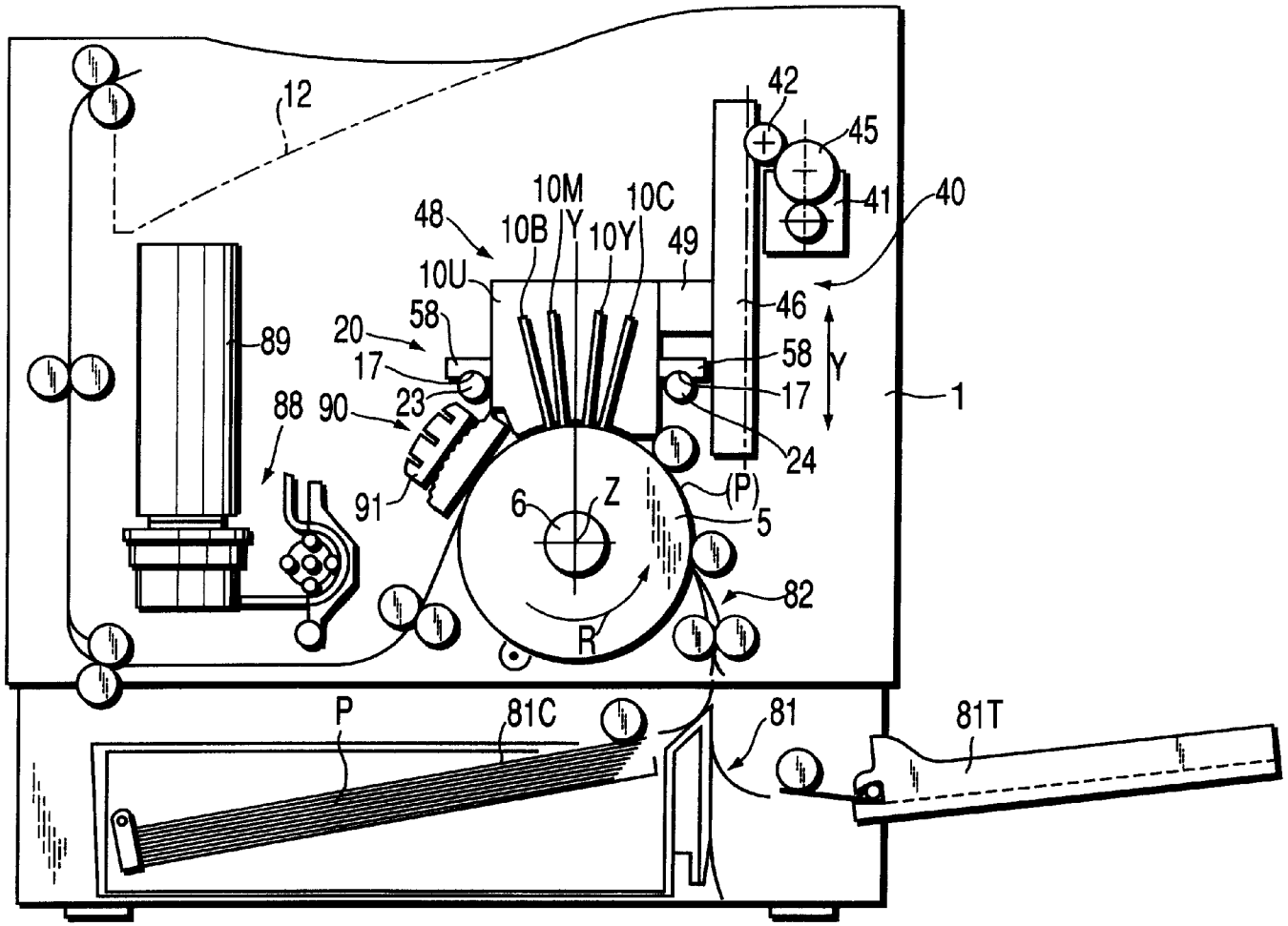
FIG 1 is a sectional view of a whole ink-jet printer according to a first embodiment of the present invention.

Hereinafter, referring to the accompanying drawings, embodiments of the present invention will be explained in detail.

First, the configuration of a whole ink-jet printer according to a first embodiment of the present invention will be explained briefly. The ink-jet printer includes a rectangular-box-like housing 1. rotating body functioning as a printing medium holding member, for example, a drum 5, is supported in a rotatable manner in the middle of the housing. Above the drum 5, there is provided a nozzle unit 10U with nozzle heads 10C, 10Y, 10M, and 10B of plural colors, for example, four colors (cyan C, yellow Y, magenta M, and black B). The nozzle unit 10U is arranged in such a manner that it can move up and down freely between the printing position (shown in the figure) where printing is done on the sheet of paper on the drum 5 and the non-printing position (explained later) which is located above the printing position and is used for the maintenance of the nozzle heads 10C, 10Y, 10M, and 10B. Inside the housing 1, an elevating mechanism 40 for raising and lowering the nozzle unit 10U is provided.

Below the drum 5, there is provided a paper feeder section 81 including a sheet cassette 81C and a manual feeder tray 81T. The sheet cassette 81C houses sheets of paper P serving as a printing medium. Inside the housing 1, there is further provided a convey mechanism 82 which not only conveys an ordinary sheet sent from the paper feeder section 81 to the drum 5 but also conveys the printed sheet onto an outlet tray 12 provided on the top surface of the housing.

Additionally, inside the housing 1, there are provided an ink supply mechanism 88 and a cleaning mechanism 90 acting as a maintenance mechanism. The ink supply mechanism includes an ink tank 89 and a supply pump and supplies ink to each head nozzle. The cleaning mechanism cleans the head nozzles 10C, 10Y, 10M, and 10B.

In the ink-jet printer, the convey mechanism 82 winds the sheet P sent from the paper feeder section 80 around the outer surface of the drum 5 and at the same time, the ink supply mechanism 88 supplies ink to the individual nozzle heads 10C, 10Y, 10M, and 10B of the nozzle unit 10U. With the nozzle unit 10U positioned in the printing position, the specific nozzle heads shoot ink at the sheet P, thereby effecting color printing. The convey mechanism 82 lets out the printed sheet P onto the outlet tray 12. To clean the nozzle heads 10C, 10Y, 10M, and 10B, the cleaning mechanism 90 is moved to the space between the nozzle heads and the drum 5, after the elevating mechanism 40 has moved the nozzle unit 10U to the non-printing position. Then, the cleaning mechanism cleans the individual nozzle heads.

Figure 2:
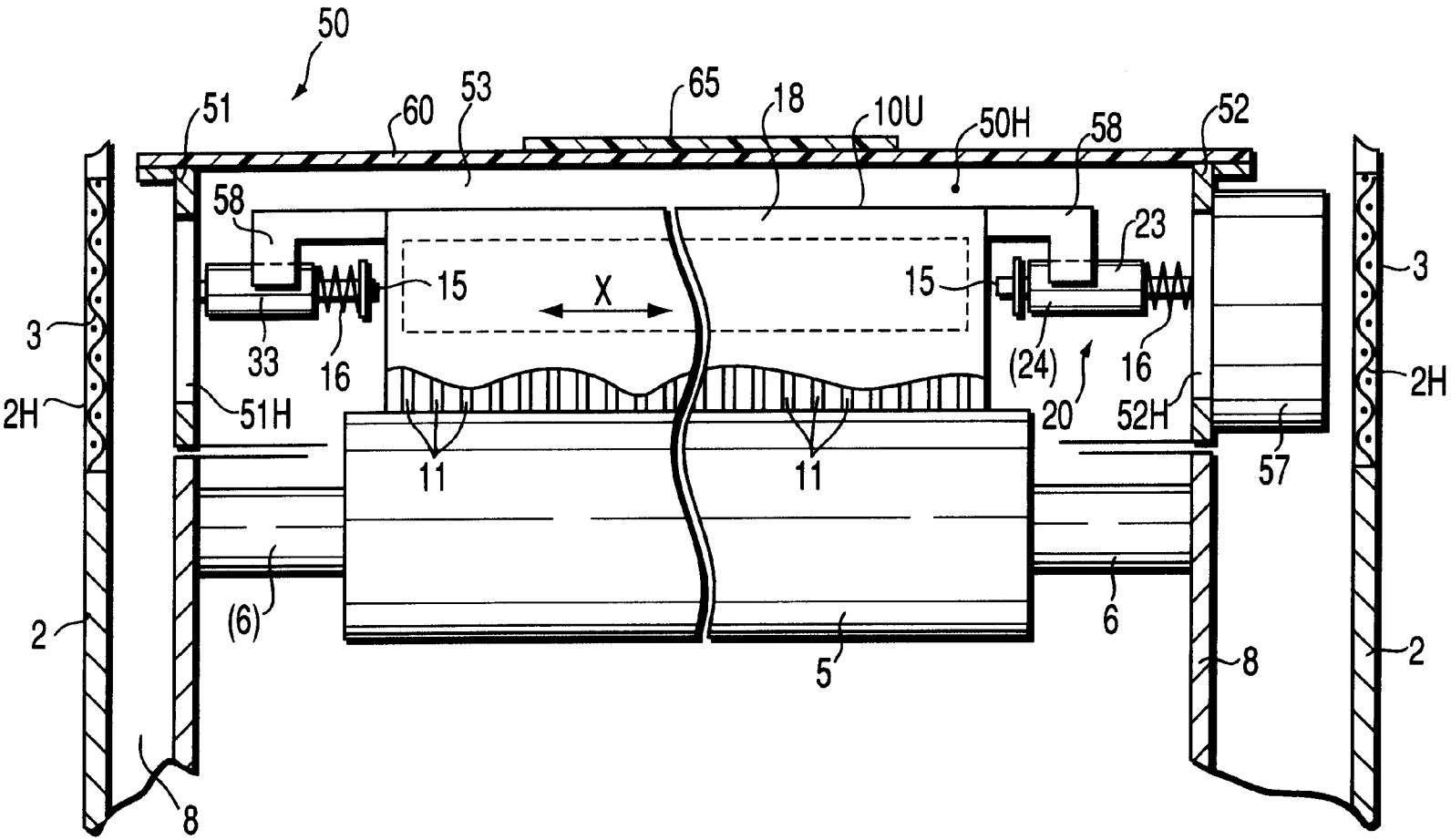
FIG. 2 is a side view of the nozzle unit, head holder, and drum of the ink-jet printer.

Next, the configuration of each section will be described in detail. As shown in FIGS. 1 and 2, the housing 1 has a pair of sidewalls 2 facing each other. Between the sidewalls, a pair of brackets 8 are provided in parallel with each other. The rotating shaft 6 of the drum 5 is supported by the pair of brackets 8 in a rotatable manner and extends almost horizontally. The drum 5 is rotated at a high speed, for example, at 120 rpm on the central axis in the direction of feed or in the direction of R. Then, a sheet holding section (not shown) winds the sheet P conveyed by the convey mechanism 82 around the outer surface of the drum 5. The sheet P rotates in synchronization with the outer surface of the drum. The sheet wound around the drum 5 makes the printing surface.

Figure 3A:
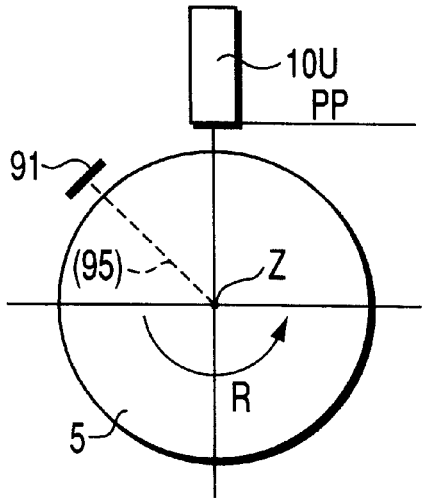
FIGS. 3A to 3D schematically show different moving position of the nozzle unit with respect to the drum.
Figure 3B:
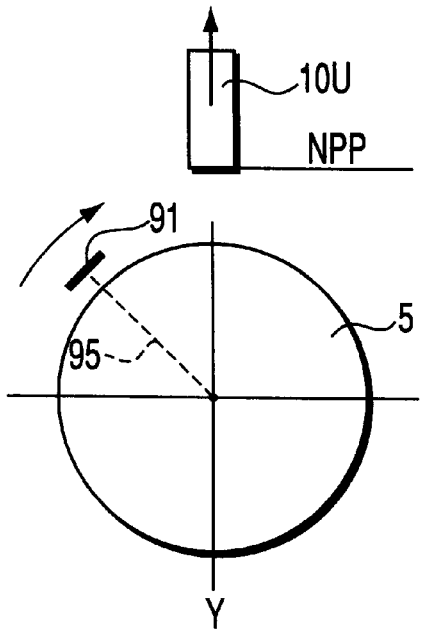

As shown in FIG. 1, the elevating mechanism 40 includes a motor 41 provided on the housing 1 side, a worm gear mechanism 45, a pinion 42, and a rack member 46 provided in such a manner that it can move freely in the vertical direction Y. The nozzle unit 10U is connected via a head holder 48 to the rack member 46. Driving the motor 41 causes the nozzle unit 10U together with the rack member 46 to move up and down along the Y-axis. The nozzle unit 10U, as shown in FIG. 3A, can move up and down along the Y-axis between the printing position PP where printing is done and the non-printing position NPP that is a specific distance above the printing position as shown in FIG. 3B. The printing position PP faces the drum, with a specific gap between them. Furthermore, the nozzle unit 10U, as shown in FIG. 3D, is located between the printing position PP and the non-printing position NPP and can be stopped and positioned at the maintenance position MP to maintain the nozzle heads in the nozzle unit 10U.

The cleaning mechanism 90 of FIG. 1 includes a washing board 91. The washing board 91 is supported by a rotating mechanism 95 in such a manner that it can move around the rotational axis of the drum 5 between the standby position shown in FIG. 3A and the cleaning position shown in FIGS. 3C and 3D.

Figure 3C:
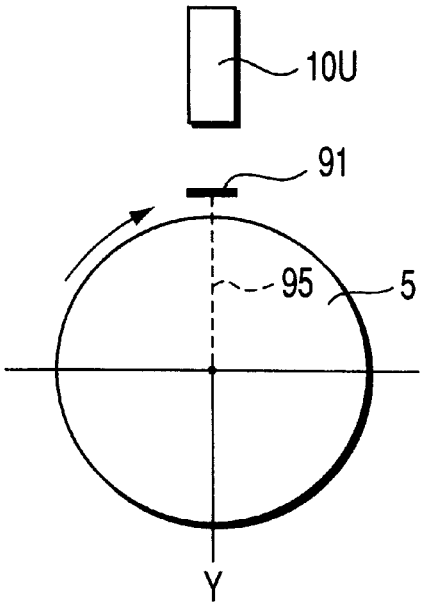
Figure 3D:
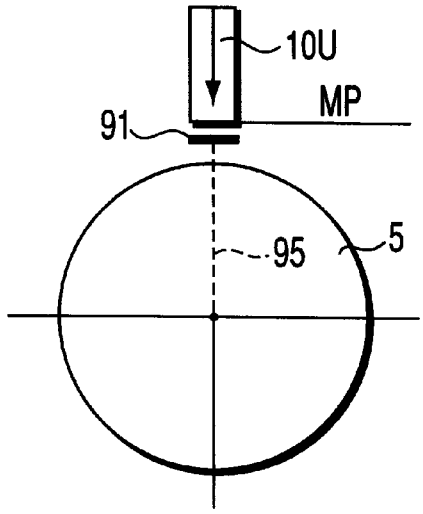

In maintenance, after the nozzle unit 10U has been moved to the non-printing position NPP shown in FIG. 3B, the rotating mechanism 95 rotates the washing board 91 from the standby position shown in FIG. 3A to the cleaning position shown in FIG. 3C and positions the board 91 between the drum 5 and the nozzle unit 10U. Thereafter, as shown in FIG. 3D, the elevating mechanism 40 lowers the nozzle unit 10U to the maintenance position MP, with the result that the nozzle unit 10U faces the washing board 91 adjacently.

In this state, the individual nozzle heads 10C, 10Y, 10M, and 10B of the nozzle unit 10U shoot ink to prevent each nozzle head from clogging up. At that time, the washing board 91 receives the ink ejected from the individual nozzle heads and discharges the ink into, for example, a waste ink bottle. The washing board 91 is designed to form an ink flow layer between the board 91 and the tip face of each nozzle head by using the ink being ejected, to remove paper powder adhered to the tip face of each nozzle.

As shown in FIGS. 1 and 2, in the nozzle unit 10U, the nozzle heads 10C, 10Y, 10M, and 10B of four colors are disposed in such a manner that they are spaced at specific intervals in the direction of R in which the drum 5 rotates. Each nozzle head includes a large number of ink-jet nozzles 11 arranged in parallel in the direction of main scanning X, or in the direction of the axis of the drum 5. Each nozzle 11 extends radially with respect to the drum 5, that is, extends perpendicular to the printing surface of the sheet P wound around the outer surface of the drum. The tips of the ink-jet nozzles 11 of the individual nozzle heads 10C, 10Y, 10M, and 10B are so arranged that they are on a circular locus corresponding to the outer surface of the drum 5 and that they have a specific gap, for example, 1-mm, at the printing position PP shown in FIGS. 1 and 2 with respect to the printing surface. Moreover, the nozzle unit 10U is provided with a driver 18 for driving each ink-jet nozzle 11.

Figure 4:
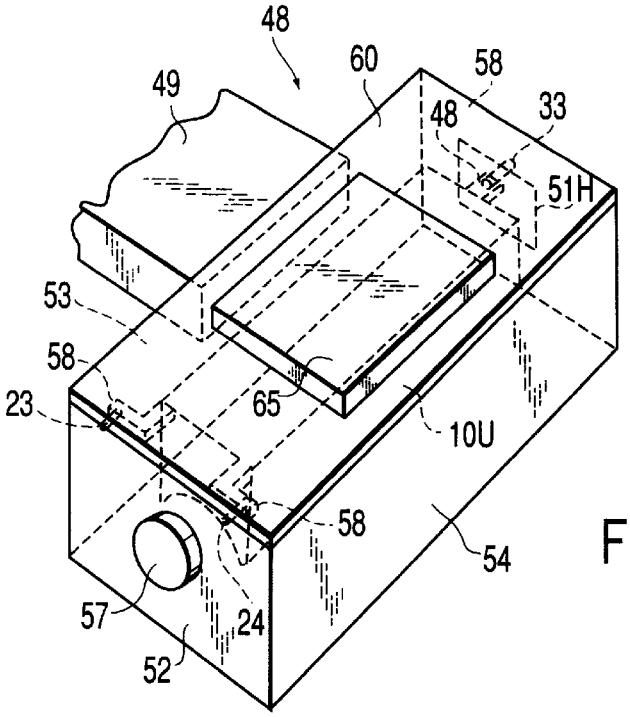
FIG. 4 is a perspective view of the head holder.

As shown in FIGS. 1, 2, and 4, the head holder 48 includes an almost rectangular cover 50 that surrounds the nozzle unit 10U and a connecting arm 49 that connects the cover to the rack member 46 of the elevating mechanism 40. The cover 50 includes a left side plate 51 and a right side plate 52 that extend in the direction perpendicular to the rotating shaft of the drum 5 and a back plate 53 and a front plate 54 that extend in parallel with the rotating shaft of the drum 5. The top side and bottom side are open. The cover 50 is coupled with the rack member 46 of the elevating mechanism 40 via the head holder 48. The nozzle unit 10U is supported in the cover 50 by a head position holding mechanism 20.

The head position holding mechanism 20 is composed of a three-point supporting mechanism and also acts as a reciprocating movement guide. Specifically, the left side plate 51 and right side plate 52 of the cover 50 are spaced apart from each other in the direction of main scanning X and positioned so as to face both ends of the nozzle unit 10U. The left side plate 51 and right side plate 52 are nearly the same distance apart from the pair of brackets 8 on the housing 1 side. The three-point supporting mechanism includes a pair of guide rollers 23, 24 provided on the light plate 52 and a guide roller 33 provided on the left side plate 51. The guide rollers 23, 24 are separated in the direction of R, or in the direction of rotation of the drum 5.

A rotating shaft 15 extending in the direction of main scanning X is fixed to each of the right and left side plates 51 and 52. Guide rollers 23, 24, 33 are supported in such a manner that they allow the rotating shaft 15 to rotate freely and slide freely in the direction of main scanning X. Each guide roller is held in a specific position elastically by a spring 16 mounted on the rotating shaft 15 and can slide in a specific range.

The nozzle unit 10U has a pair of hangers 58 extending from its right end and a hanger 58 extending from its left end. In the bottom surface of each hanger, a V-shaped groove 17 (see FIG. 1) is made. The nozzle unit 10U is supported on the guide rollers 23, 24, 33, with the guide rollers being engaged with the corresponding grooves 17 in the hanger 58.

Therefore, the nozzle unit 10U, together with the cover 50, can be moved up and down by the elevating mechanism 40 between the printing position PP and the non-printing position NPP and is supported in such a manner that it can move in the direction of main scanning X in the specific range. At the printing position PP, the three-point supporting mechanism holds the nozzle unit 10U stably by gravitation in an accurate relative position (three-dimensional position) with respect to the printing surface (the outer surface of the drum 5). At the same time, use of the three-point support mechanism simplifies the configuration and reduces cost.

Furthermore, the three-point supporting mechanism also functions as a reciprocating movement guide and allows the nozzle unit 10U to move back and forth in the direction of x during printing. In the first embodiment, the reciprocating movement distance is set at a pitch corresponding to the print resolution (e.g., 300 dpi). The installation pitch in the direction of X of the ink-jet nozzles 11 each of the nozzle heads 10C, 10Y, 10M, 10B has is set at twice the pitch corresponding to the print resolution.

As shown in FIGS. 2 and 4, an upper opening 50H in the cover 50 is closed by a rectangular printed-circuit board 60 provided on the cover. On the printed-circuit board 60, a driving control circuit 65 is mounted. The driving control circuit 65 is connected not only to a driver 18 for the nozzle heads 10C, 10Y, 10M, 10B of the nozzle unit 10U via many harnesses (not shown) but also to an external circuit section via another harness.

In the cover 50, ventholes 51H, 52H are made in at least two side plates facing each other, for example, the right and left side plates 51, 52, respectively. The ventholes are for letting fresh air into the inside of the cover 50 to cool the nozzle unit 10U and printed-circuit board 60. The ventholes 51H, 52H are located at the height of the nozzle unit 10U to make it possible to air-cool the driver 18 for the nozzle heads 10C, 10Y, 10M, 10B provided in the nozzle unit 10U. In addition, a fan 57 is provided on the outer surface of the right side plate 52 in such a manner that the fan faces the venthole 52H. The fan forces cooling air to flow from the outside into the inside of the cover through the venthole 52H.

Furthermore, inlet and outlet holes 2H for fresh air are so made in the sidewall 2 of the housing 1 that they correspond to the ventholes 51H, 52H in the cover 50. Mesh plates 3 are put over the inlet and outlet holes 2H to prevent foreign matter to coming in. Fresh air lower in temperature than the inside atmosphere can be supplied through the inlet and outlet holes 2H, which helps cool the driving control circuit 65 and nozzle unit 10U significantly.

With the ink-jet printer constructed as described above, in printing, the sheet P sent from the paper feeder section 80 is wound around the outer surface of the drum 5 and held in place by the convey mechanism 82. At the same time, the ink supply mechanism 88 supplies ink to the individual nozzle heads 10C, 10Y, 10M, 10B of the nozzle unit 10U. Then, the nozzle unit 10U is moved by the elevating mechanism 40 to the printing position PP. This causes the tips of the individual nozzle heads 10C, 10Y, 10M, 10B to face the printing surface of the sheet P wound around the outer surface of the drum 5, with a gap of about 1 mm between the tips and the printing surface.

In this state, while the selected ink-jet nozzle 11 of the nozzle heads 10C, 10Y, 10M, 10B is shooting ink at the sheet P, the drum 5 is rotated to move the sheet P in the direction of feed R, thereby effecting color printing on the sheet P. For example, color printing can be done on a A-4 sheet at a high speed of 20 ppm. The printed sheet P is conveyed by the convey mechanism 82 onto the outlet tray 12.

In the ink-jet printer, the nozzle unit 10U is so provided that it can move up and down freely between the printing position and the non-printing position located above the printing position. In the printing position, the head position holding mechanism composed of the three-point supporting mechanism positions and holds the nozzle unit in place by gravitation. Therefore, the nozzle heads can be positioned quickly and accurately, with a specific gap.

Because the driving control circuit 65 is provided on the cover 50 of the nozzle unit 10U and can move up and down together with the nozzle heads 10C, 10Y, 10M, 10B of the respective colors, the length of the harnesses connecting the driving control circuit 65 to the individual nozzle heads can be minimized. As a result, it is not necessary to elongate the harnesses and give them a wide curve, which helps reduce production cost, simplify the layout of the inside of the housing 1, and make the printer smaller.

The printed-circuit board 60 (the individual driving circuits and the corresponding control circuits) is placed close to the nozzle heads 10C, 10Y, 10M, 10B. The driving control circuit 65 is particularly provided on the opposite side of the drum 5 with respect of each head of the nozzle unit 10U, that is, on the outer surface of the printed-circuit board 60. This makes it easy to connect wires to the harnesses, which facilitates the adjustment and handling of each nozzle head.

The print-circuited board 60 can be formed to a size making full use of the entire area of the upper opening in the cover 50. This enables the driving control circuit 65 to have a form and structure that have greater plane dimensions and area and good heat-dissipating characteristics. Because the printed-circuit board 60, together with the nozzle unit 10U, moves up and down, the up-and-down movement enhances heat dissipation, making it easy to take positive heat-dissipating measures and cooling measures.

Because the harnesses connecting the driving control circuit 65 to the nozzle heads 10C, 10Y, 10M, 10B and the harness connecting the driving control circuit 65 to the external circuit are located outside the cover 50, the harnesses are prevented from coming into contact with the drum 5, even when the nozzle unit 10U is in an up-and-down movement.

Furthermore, when the fan 57 provided on the cover 50 is rotated, fresh air flows through the venthole 52H in the right side plate 52 into the space defined by the cover and the printed-circuit board 60 and is ejected through the venthole 51H in the left side plate 51 into the outside world. As a result, a cooling air is forced to flow toward the inside of the cover 50, thereby cooling the nozzle head 10U, printed-circuit board 60, and driving control circuit 65 rapidly and reliably.

Because the fan 57, together with the nozzle unit 10U, moves up and down, the nozzle unit, printed-circuit board 60, and driving control circuit 65 can be cooled efficiently, even when the nozzle unit 10U is not only at the printing position PP below but also at the non-printing position above.

The driving control circuit 65 is provided on the outer surface of the printed-circuit board 60, taking wiring into account. It may be provided on the inner surface of the printed-circuit board 60 from the viewpoint of improving the cooling of the driving circuit. In this case, the heat of the driving control circuit 65 can be dissipated more. The driving control circuit 65 may be provided for each of the nozzle heads 10C, 10Y, 10M, 10B. The printed-circuit board 60 may include only the driving control circuit 65 that drives the driver for the nozzle heads 10C, 10Y, 10M, 10B which produce a lot of heat.

Figure 5:
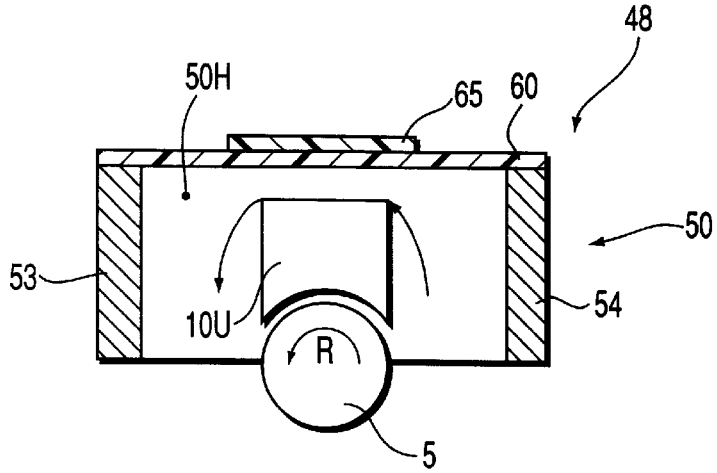
FIG. 5 is a sectional view of a head holder according to a second embodiment of the present invention.

In the first embodiment, the ventholes 51H, 52H are made in the cover 50 of the nozzle unit 10U and the fan 57 is provided on the cover, forcing fresh air to flow into the cover, which cools the nozzle unit and printed-circuit board 60. The present invention is not limited to this. For instance, as in a second embodiment of the present invention shown in FIG. 5, even when the ventholes 51H, 52H, and fan 57 are not provided for the cover 50, the cooling of the nozzle unit 10U, printed-circuit board 60, and driving control circuit 65 can be enhanced making use of a wind produced by the rotation of the drum 5.

The second embodiment not only produces a similar effect to that of the first embodiment, but also is effective when the rotation speed of the drum 5 is high, the number of ink-jet nozzles of each of the nozzle heads 10C, 10Y, 10M, 10B, and the driving control circuit 65 generates relatively little heat.

Figure 6:
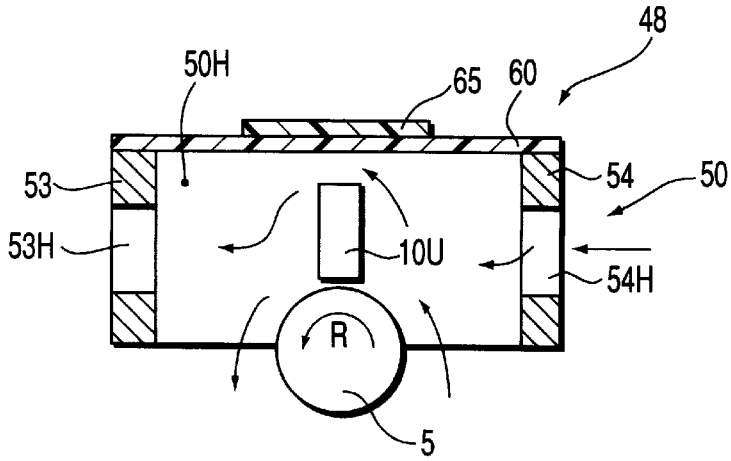
FIG. 6 is a sectional view of head holder according to a third embodiment of the present invention.

In a third embodiment of the present invention shown in FIG. 6, ventholes 54H, 53H are made in the front sidewall 54 and back sidewall 53 of the cover 50 located on the upstream side and downstream side in the direction of R, or the direction of rotation of the drum 5. Making use of the rotation of the drum 5 in one direction, the inflow of air through the venthole 54H into the inside of the cover 50 is promoted and the outflow of the air through the venthole 53H is enhanced.

Therefore, the third embodiment not only produces a similar effect to that of the second embodiment, but also induces cooling air to flow through the inside of the cover 50, which enhances the cooling of the nozzle unit 10U, printed-circuit board, and driving control circuit 65.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a medium holding member which holds a printing medium;

a head holder which supports nozzle heads and which is vertically movable between: (i) a printing position at which the nozzle heads face a printing surface of the printing medium held by the medium holding member with a specific gap and at which the nozzle heads print on the printing surface of the printing medium, and (ii) a non-printing position which is located above the printing position and at which the nozzle heads may be maintained;

an elevating mechanism which vertically moves the head holder between the printing and non-printing positions; and a driving control circuit which drives the nozzle heads and which is movable together with the head holder;

wherein the driving control circuit is located on a side of the head holder opposite to a side of the head holder which faces the medium holding member with the nozzle heads being interposed between the driving control circuit and the medium holding member, with respect to a direction in which the head holder vertically moves.

2. An ink-jet printer according to claim 1, wherein the medium holding member includes a rotating body with an outer surface around which the printing medium is wound, wherein the head holder includes:

a nozzle unit holding the nozzle heads, a substantially frame-shaped cover which has a lower opening facing the rotating body and an upper opening facing the lower opening, said frame-shaped cover being arranged to surround the nozzle unit, and a printed-circuit board which closes the upper opening of the cover and on which the driving control circuit is mounted, and wherein the cover and the printed-circuit board define a space for generating a wind to cool the nozzle unit and driving control circuit, in accordance with a rotation of the rotating body.

3. An ink-jet printer according to claim 2, wherein the cover has a pair of side plates each located on an upstream side and a downstream side in a direction of rotation of the rotating body, and wherein ventholes are formed in the side plates.

4. An ink-jet printer according to claim 1, wherein the head holder includes:

a nozzle unit holding the nozzle heads, a substantially frame-shaped cover which has a lower opening facing the printing medium holding member and an upper opening facing the lower opening, said frame-shaped cover being arranged to surround the nozzle unit and having at least two ventholes, a printed-circuit board which closes the upper opening of the cover and on which the driving control circuit is mounted, and a fresh air intake which lets fresh air inside the cover through the ventholes.

5. An ink-jet printer according to claim 4, wherein the fresh air intake comprises an air intake fan provided on the cover so as to face one of the ventholes.

6. An ink-jet printer according to claim 2, wherein the nozzle heads are arranged side by side in a direction of rotation of the rotating body, and each nozzle head comprises plural ink-jet nozzles arranged side by side in an axial direction of the rotating body.

7. An ink-jet printer according to claim 6, wherein the head holder includes a three-point mechanism that supports the nozzle unit to the cover, the three-point mechanism including three rotating shafts extending in parallel with each other from three places on the cover, rollers rotatably supported by corresponding ones of the rotating shafts, and hanger sections extending from the nozzle unit and placed on corresponding ones of the rollers.

* * * * *